US011082782B2

(12) United States Patent
Freed

(10) Patent No.: US 11,082,782 B2
(45) Date of Patent: Aug. 3, 2021

(54) SYSTEMS AND METHODS FOR DETERMINING OBJECT PROXIMITY TO A HEARING SYSTEM

(71) Applicant: Advanced Bionics AG, Staefa (CH)

(72) Inventor: Daniel J. Freed, Pasadena, CA (US)

(73) Assignee: Advanced Bionics AG, Staefa (CH)

( * ) Notice: Subject to any disclaimer, the term of this patent is extended or adjusted under 35 U.S.C. 154(b) by 0 days.

(21) Appl. No.: 16/668,128

(22) Filed: Oct. 30, 2019

(65) Prior Publication Data

US 2021/0136502 A1 May 6, 2021

(51) Int. Cl.

| | |
|---|---|
| ***H04R 25/00*** | (2006.01) |
| ***H04R 5/04*** | (2006.01) |
| ***H04R 3/00*** | (2006.01) |
| ***H04R 5/027*** | (2006.01) |

(52) U.S. Cl.

CPC ..... *H04R 25/604* (2013.01); *H04R 3/005* (2013.01); *H04R 5/027* (2013.01); *H04R 5/04* (2013.01); *H04R 2225/67* (2013.01)

(58) Field of Classification Search

None

See application file for complete search history.

(56) References Cited

U.S. PATENT DOCUMENTS

| | | | |
|---|---|---|---|
| 7,016,510 | B2 | 3/2006 | Arndt |
| 8,358,797 | B2 | 1/2013 | Fretz |
| 9,007,871 | B2 | 4/2015 | Armstrong-Muntner |
| 9,199,380 | B2 | 12/2015 | Smith |
| 2004/0141418 | A1 | 7/2004 | Matsuo |
| 2011/0003615 | A1 | 1/2011 | Langereis |

FOREIGN PATENT DOCUMENTS

| | | |
|---|---|---|
| EP | 2278356 | 10/2013 |

*Primary Examiner* — Paul W Huber

(74) *Attorney, Agent, or Firm* — ALG Intellectual Property, LLC

(57) ABSTRACT

An exemplary passive acoustic proximity detection system is configured to determine a first acoustic spectrum of a first signal representative of audio detected and output by a first microphone configured to be positioned at an ear canal entrance of a user. The detection system is further configured to determine a second acoustic spectrum of a second signal representative of audio detected and output by a second microphone configured to be located away from the ear canal entrance. Based on a comparison of the first acoustic spectrum and the second acoustic spectrum, the detection system is configured to generate a proximity indicator indicative of a proximity of an object to the first microphone. Based on the proximity indicator, the detection system is configured to select a signal processing program for execution by the passive acoustic detection system.

20 Claims, 10 Drawing Sheets

SYSTEMS AND METHODS FOR DETERMINING OBJECT PROXIMITY TO A HEARING SYSTEM

BACKGROUND INFORMATION

A hearing device may be configured to selectively provide audio content from various sources to a user wearing the hearing device. For example, a hearing device may be configured to operate in accordance with a first signal processing program in which the hearing device renders or provides ambient audio content detected by a microphone to a user. The hearing device may alternatively operate in accordance with a second signal processing program in which the hearing device provides more focused audio from a localized source (e.g., a phone, a headset, or other suitable device).

In some scenarios, it may be desirable for a hearing device to dynamically and automatically switch between the first and second signal processing programs described above or to select one from a plurality of signal processing programs. For example, while a hearing device is operating in accordance with the first signal processing program described above to present ambient sound to a user of the hearing device, the user may receive a telephone call on a mobile phone and place the mobile phone to the user's ear. In this example, it may be desirable for the hearing device to dynamically and automatically switch from operating in accordance with the first signal processing program to operating in accordance with the second signal processing program described above so that the user may more clearly hear the audio from the mobile phone. Heretofore, to do this, the user has had to manually provide input representative of a command for the hearing device to switch from one signal processing program to another. Such manual interaction is cumbersome, time consuming, and inefficient, and may result in less audio clarity for the user.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
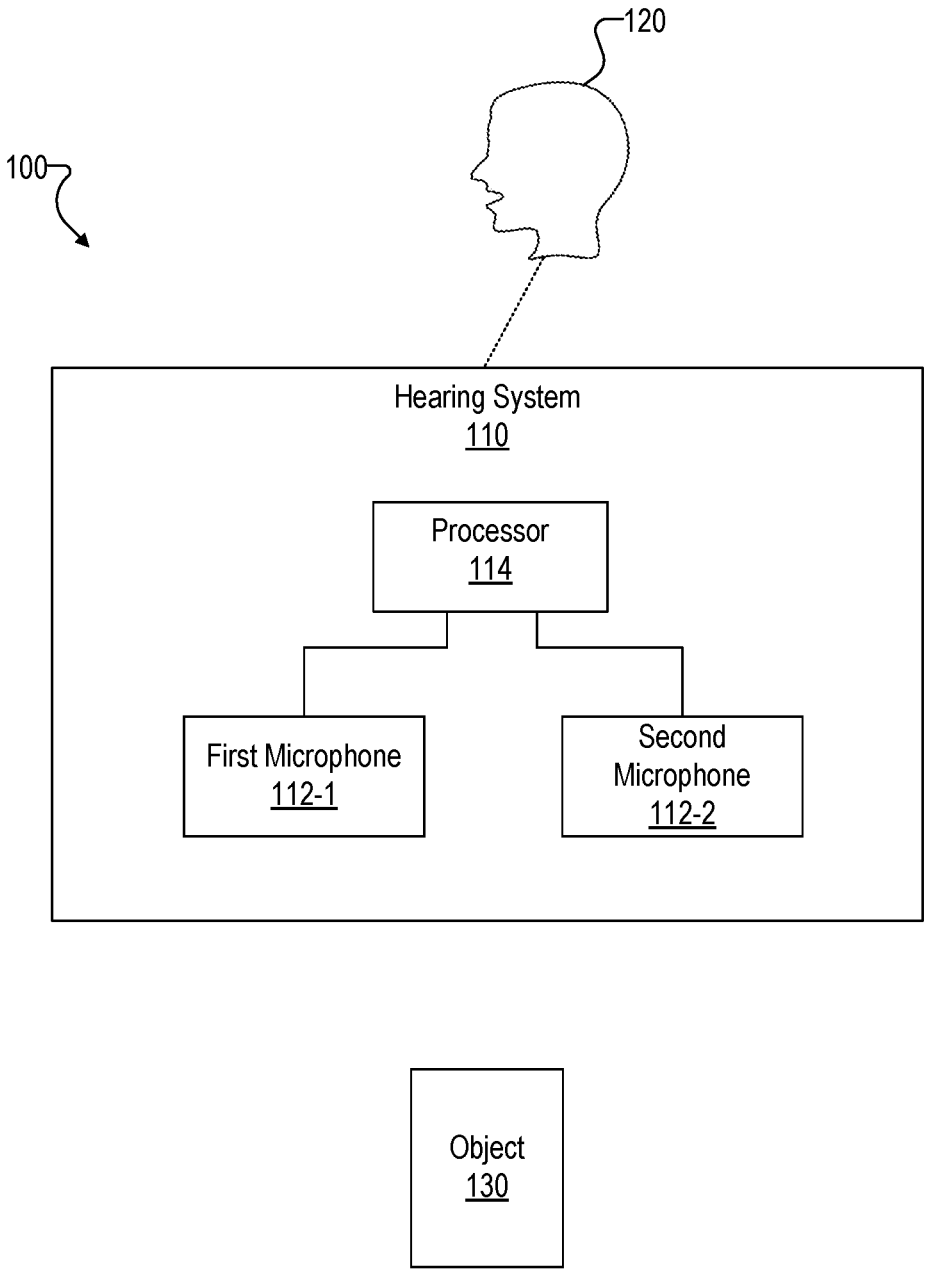
FIG. 1 illustrates an exemplary configuration in which a hearing system is configured to detect a proximity of an object according to principles described herein.

Systems and methods for determining a proximity of an object to a hearing system to dynamically and automatically select a signal processing program for execution by a processor of the hearing system are described herein. For example, a hearing system associated with a first ear of a user may include a first microphone configured to be positioned at an ear canal entrance of the first ear of the user, a second microphone disposed on a component of the hearing system configured to be located away from the ear canal entrance, and a processor communicatively coupled to the first and second microphones. The first microphone may be configured to output a first signal representative of audio detected by the first microphone, and the second microphone may be configured to output a second signal representative of audio detected by the second microphone. The processor may be configured to determine a first acoustic spectrum of the first signal output by the first microphone and a second acoustic spectrum of the second signal output by the second microphone. The processor may be further configured to generate, based on a comparison of the first acoustic spectrum and the second acoustic spectrum, a proximity indicator indicative of a proximity of an object to the first microphone, and to select, based on the proximity indicator, a signal processing program for execution by the processor.

As another example, a passive acoustic detection system separate from a hearing system may determine a first acoustic spectrum of a first signal representative of audio detected and output by a first microphone configured to be positioned at an ear canal entrance of a user. The detection system may further determine a second acoustic spectrum of a second signal representative of audio detected and output by a second microphone configured to be located away from the ear canal entrance. The detection system may generate a proximity indicator indicative of a proximity of an object to the first microphone based on a comparison of the first acoustic spectrum and the second acoustic spectrum. The detection system may then select a signal processing program for execution by a processor included in the hearing system based on the proximity indicator. In some examples, the detection system may transmit an instruction to the processor for the processor to begin executing the selected signal processing program.

The systems and methods described herein may be used in connection with any suitable type of hearing system that includes multiple microphones. For example, the systems and methods described herein may be used in connection with a hearing device configured to acoustically present audio to a user and/or in connection with a cochlear implant system configured to apply electrical stimulation representative of audio to a user.

The systems and methods described herein may advantageously provide many benefits to a user of a hearing system. For example, the systems and methods described herein may allow for real-time and intelligent selecting of signal processing programs for execution by a processor of a hearing system based on a proximity of an object to the hearing system (e.g., to a microphone included in the hearing system). This, in turn, may optimize sound clarity and provide a seamless listening experience for the user without the need for additional hardware to be included in the hearing system. These and other advantages and benefits of the systems and methods described herein will be made apparent herein.

FIG. 1 illustrates an exemplary configuration 100 in which a hearing system 110 used by a user 120 is configured to detect a proximity of an object 130 to hearing system 110 according to principles described herein. As shown, hearing system 110 includes a first microphone 112-1 and a second microphone 112-2 (collectively "microphones 112"). Hearing system 110 also includes a processor 114 communicatively coupled to microphones 112. Hearing system 110 may include additional or alternative components as may serve a particular implementation. For example, hearing system 110 may include an output transducer (e.g., a loudspeaker) configured to provide amplified audio to user 120 and/or a cochlear implant configured to provide electrical stimulation representative of audio to user 120.

Microphones 112 may be configured to detect audio presented to user 120. Such audio may include, for example, audio content (e.g., music, speech, noise, etc.) generated or otherwise provided by one or more audio sources included in an environment of user 120.

Microphones 112 may be included in or communicatively coupled to hearing system 110 in any suitable manner. For example, microphone 112-1 may be configured to be positioned at an ear canal entrance of the user and output a first signal representative of audio detected by microphone 112-1, and microphone 112-2 may be disposed on a component of hearing system 110 configured to be located or positioned away from the ear canal entrance and output a second signal representative of audio detected by microphone 112-2. For example, first microphone 112-1 may be implemented by a microphone that is configured to be placed within the concha of the ear near the entrance to the ear canal, such as a T-MICT™ microphone from Advanced Bionics. Such a microphone may be held within the concha of the ear near the entrance of the ear canal by a boom or stalk that is attached to an ear hook configured to be selectively and removably attached to a housing for processor 114. In this implementation, microphone 112-2 may be disposed on or in the housing. In yet another example, hearing system 110 may include a housing configured to house processor 114 and a headpiece separate from the housing and configured to house a coil used by processor 114 to wirelessly communicate with a cochlear implant. In this example, microphone 112-2 may be disposed on or in the headpiece, while microphone 112-1 may be disposed on or in the housing and/or selectively attached to the housing. In yet another example, both microphones 112 may be disposed on or in the housing. Additionally or alternatively, hearing system 110 may include additional microphones which may also provide more information or additional data points for analysis as described herein.

Processor 114 may be configured to perform various processing operations associated with providing audio to user 120. For example, as described herein, processor 114 may be configured to receive a first signal output by microphone 112-1 and a second signal output by microphone 112-2. Processor 114 may be further configured to determine a first acoustic spectrum of the first signal output by microphone 112-1, and to determine a second acoustic spectrum of the second signal output by microphone 112-2. Processor 114 may be further configured to generate, based on a comparison of the first acoustic spectrum and the second acoustic spectrum, a proximity indicator indicative of a proximity of object 130 to microphone 112-1, and to select, based on the proximity indicator, a signal processing program for execution by the processor 114. These operations are described in more detail herein.

Object 130 may include any suitable device, article, or thing that may be selectively brought into proximity of hearing system 110. For example, object 130 may include a mobile device (e.g., a mobile phone), a computer, a telephone handset, a headphone, an earbud, an audio speaker, or any other such device that is configured to emit or provide audio that may be detected by microphones 112. Object 130 may additionally or alternatively include a hand or other thing that does not actively emit or provide audio. In some examples, object 130 may be configured to communicate with hearing system 110.

Object 130 may be selectively brought into proximity of hearing system 110 in any suitable manner. For example, as described herein, if hearing system 110 is implemented by a hearing device configured to be worn behind an ear of user 120, object 130 may be brought into proximity of hearing system 110 by being placed by user 120 at or near an entrance to an ear canal of user 120. As an illustration, if object 130 is a mobile phone, object 130 may be brought into proximity of hearing system 110 when user 120 places the mobile phone at his or her ear to receive a phone call on the mobile phone.

Advantageously, the presence of object 130, such as a mobile phone or telephone handset, closer to one microphone (e.g., microphone 112-1) than the other microphone (e.g., microphone 112-2) may produce distinctly different acoustic effects at the two microphones 112. This difference may be used to detect the proximity of object 130 to hearing system 110 (e.g., to microphone 112-1). Upon detecting that object 130 is relatively proximate to microphone 112-1, a desired signal processing program may be dynamically and automatically selected for execution by processor 114 according to principles described herein.

Figure 2:
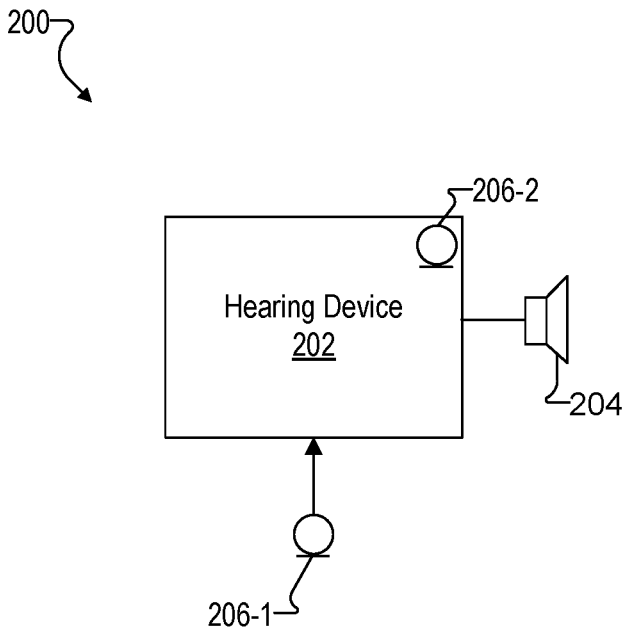
FIG. 2 illustrates an exemplary implementation of the hearing system of FIG. 1 according to principles described herein.

FIG. 2 illustrates an exemplary implementation 200 of hearing system 110. As shown, implementation 200 includes a hearing device 202 configured to acoustically present audio to a user by way of a receiver 204 (also referred to as a loudspeaker). As shown, a first microphone 206-1 implementing microphone 112-1 may be separate from and communicatively coupled to hearing device 202, while a second microphone 206-2 implementing microphone 112-2 may be disposed on hearing device 202. Microphones 206-1 and 206-2 may be collectively referred to as "microphones 206". In this configuration, hearing device 202 (implementing processor 114) may receive signals output by microphones 206 and acoustically present audio based on the signals to the user.

Figure 3:
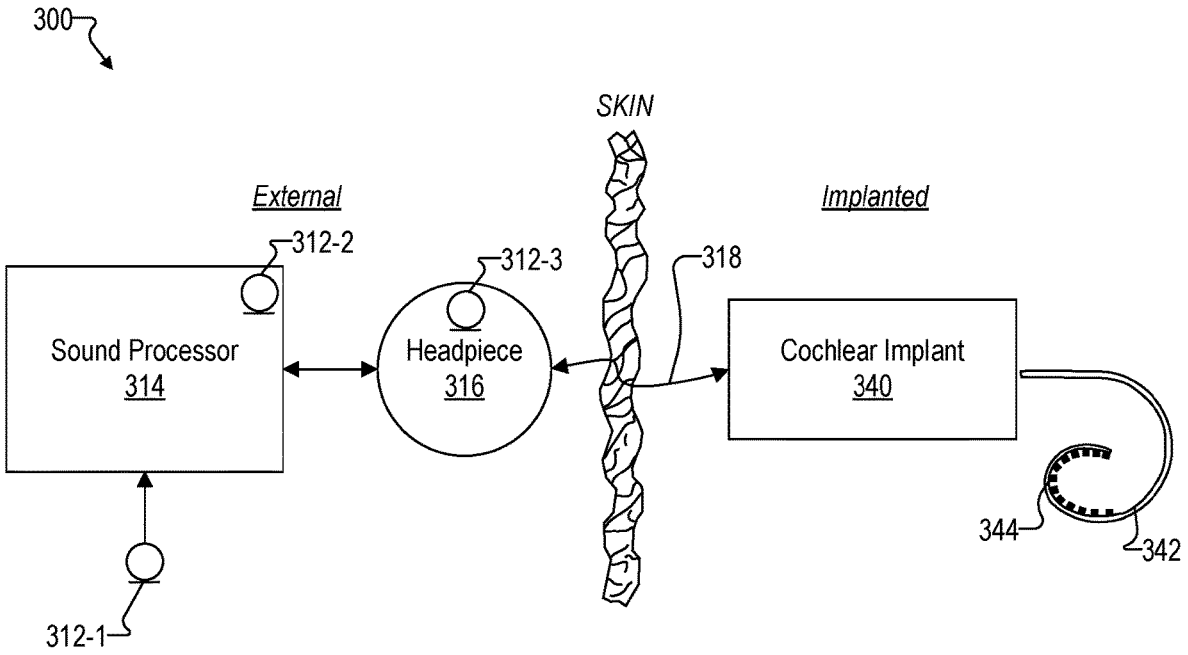
FIG. 3 illustrates another exemplary implementation of the hearing system of FIG. 1 according to principles described herein.

FIG. 3 illustrates another exemplary implementation 300 of hearing system 110. Implementation 300 is referred to herein as a cochlear implant system 300 and is configured to provide electrical stimulation representative of audio to a user. As shown, implementation 300 includes a first microphone 312-1, a second microphone 312-2, a third microphone 312-3 (hereinafter also referred to collectively as "microphones 312"), a sound processor 314, a headpiece 316 having a coil disposed therein, a cochlear implant 340, and an electrode lead 342. Electrode lead 342 may include an array of electrodes 344 disposed on a distal portion of electrode lead 342 and that are configured to be inserted into a cochlea of a user to stimulate the cochlea when the distal portion of electrode lead 342 is inserted into the cochlea. One or more other electrodes (e.g., including a ground electrode, not explicitly shown) may also be disposed on other parts of electrode lead 342 (e.g., on a proximal portion of electrode lead 342) to, for example, provide a current return path for stimulation current generated by electrodes 344 and to remain external to the cochlea after electrode lead 342 is inserted into the cochlea. As described herein, electrode lead 342 may be naturally pre-curved or straight. Additional or alternative components may be included within implementation 300 as may serve a particular implementation.

As shown, implementation 300 may include various components configured to be located external to a user including, but not limited to, microphones 312, sound processor 314, and headpiece 316. Implementation 300 may further include various components configured to be implanted within the user including, but not limited to, cochlear implant 340 and electrode lead 342.

Microphones 312 may be configured to detect audio signals presented to the user in a similar way as described above. Microphones 312 may be implemented in any suitable manner. For example, first microphone 312-1 may include a microphone that is configured to be placed within the concha of the ear near the entrance to the ear canal, such as a T-MIC™ microphone from Advanced Bionics. Such a microphone may be held within the concha of the ear near the entrance of the ear canal during normal operation by a boom or stalk that is attached to an ear hook configured to be selectively attached to sound processor 314. Second microphone 312-2 and third microphone 312-3 may each include a microphone configured to be located away the ear canal of the user. Additionally or alternatively, microphones 312-2 and 312-3 may be implemented by one or more microphones disposed within sound processor 314, one or more microphones disposed within headpiece 316, one or more beam-forming microphones, and/or any other suitable microphone as may serve a particular implementation.

Sound processor 314 may be housed within any suitable housing (e.g., a behind-the-ear ("BTE") device, a body worn device, a fully implantable device, headpiece 316, and/or any other sound processing unit as may serve a particular implementation). Sound processor 314 may implement processor 114 and may be configured to direct cochlear implant 340 to generate and apply electrical stimulation (e.g., a sequence of stimulation pulses) by way of one or more electrodes 344.

In some examples, sound processor 314 may wirelessly transmit stimulation parameters (e.g., in the form of data words included in a forward telemetry sequence) and/or power signals to cochlear implant 340 by way of a wireless communication link 318 between headpiece 316 and cochlear implant 340 (e.g., a wireless link between a coil disposed within headpiece 316 and a coil physically coupled to cochlear implant 340). It will be understood that communication link 318 may include a bi-directional communication link and/or one or more dedicated uni-directional communication links.

Headpiece 316 may be communicatively coupled to sound processor 314 and may include an external antenna (e.g., a coil and/or one or more wireless communication components) configured to facilitate selective wireless coupling of sound processor 314 to cochlear implant 340. Headpiece 316 may additionally or alternatively be used to selectively and wirelessly couple any other external device to cochlear implant 340. To this end, headpiece 316 may be configured to be affixed to the user's head and positioned such that the external antenna housed within headpiece 316 is communicatively coupled to a corresponding implantable antenna (which may also be implemented by a coil and/or one or more wireless communication components) included within or otherwise associated with cochlear implant 340. In this manner, stimulation parameters and/or power signals may be wirelessly transmitted between sound processor 314 and cochlear implant 340 via communication link 318.

Cochlear implant 340 may include any suitable type of implantable stimulator. For example, cochlear implant 340 may be implemented by an implantable cochlear stimulator. Additionally or alternatively, cochlear implant 340 may include a brainstem implant and/or any other type of cochlear implant that may be implanted within a user and configured to apply stimulation to one or more stimulation sites located along an auditory pathway of a user. Cochlear implant 340 may be configured to generate electrical stimulation in accordance with one or more stimulation parameters transmitted thereto by sound processor 314.

In some examples, sound processor 314 may be configured to apply both electrical and acoustic stimulation to a user. For example, a receiver (not shown) may be optionally coupled to sound processor 314 and configured to deliver acoustic stimulation to the user as directed by sound processor 314.

Figure 4:
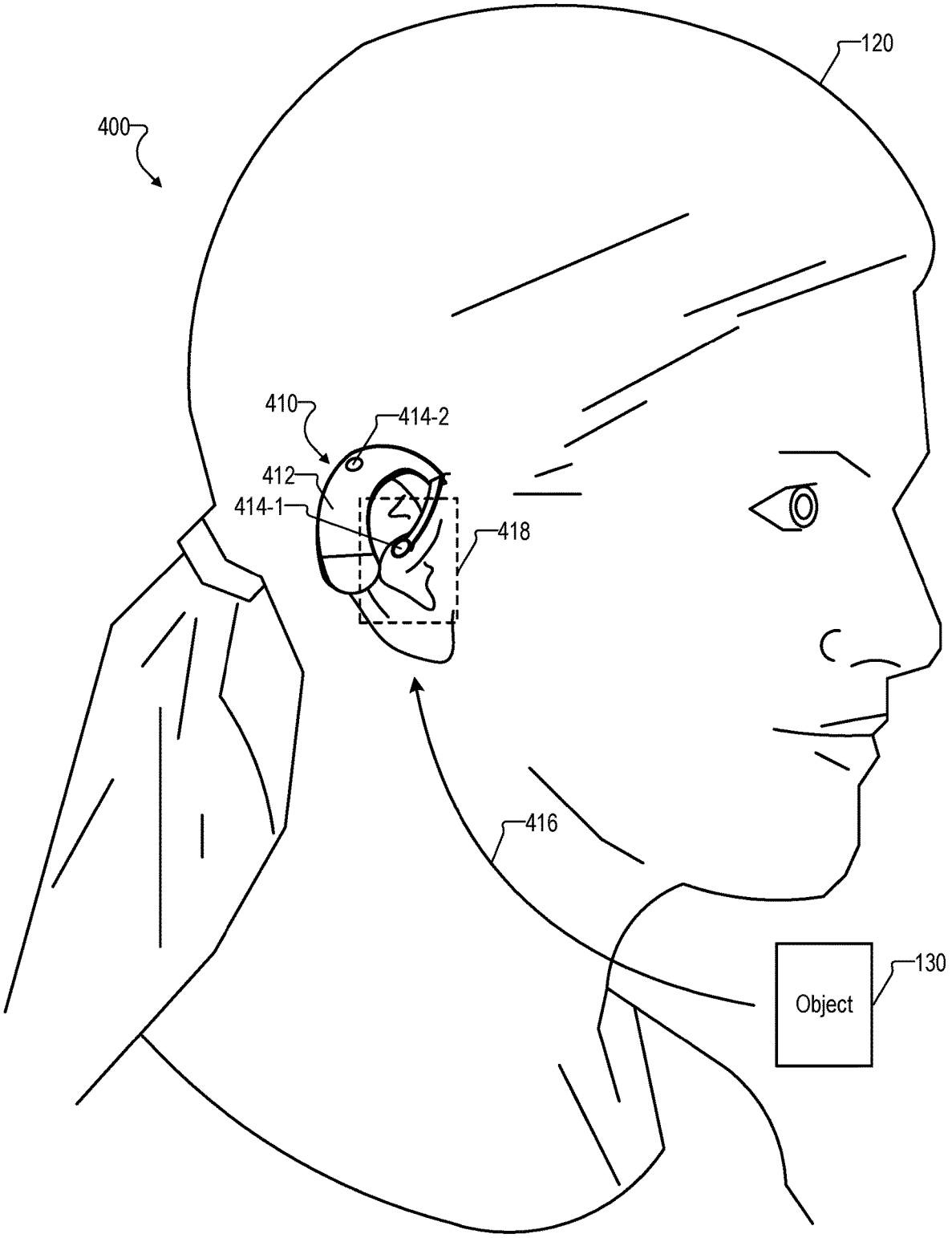
FIG. 4 illustrates an exemplary scenario according to principles described herein.

FIG. 4 illustrates an exemplary scenario 400 in which hearing system 110 is implemented by a behind-the-ear (BTE) device 410 that is worn by user 120. As shown, BTE device 410 includes a housing 412 configured to be worn behind an ear of user 120. Housing 412 may house processor 114 and/or any other component of hearing system 110. As shown, a first microphone 414-1 (implementing microphone 112-1) extends away from housing 412 and is positioned at an ear canal entrance of user 120. As described above, microphone 414-1 may be implemented by a T-MIC™ microphone from Advanced Bionics or any other suitable microphone configured to be positioned at the ear canal entrance. Microphone 412-2 (implementing microphone 112-2) is disposed on housing 412 and is therefore positioned away from the ear canal entrance.

As shown, object 130 may be initially located relatively far from BTE device 410. While object 130 is in this position, processor 114 may be configured to execute a first signal processing program (e.g., a signal processing program that includes beamforming). Exemplary signal processing programs are described herein.

As indicated by arrow 416 and dashed box 418, object 130 may be repositioned to be relatively close to BTE device 410. In this position, object 130 may cover microphone 414-1, or at least be closer to microphone 414-1 than to microphone 414-2. Processor 114 may detect, based on a difference in the signals output by microphones 414, that object 130 is within a proximity threshold of microphone 414-1 and, in response, switch to operating in accordance with a second signal processing program (e.g., a signal processing program that does not include beamforming and/or that emphasizes audio content detected by microphone 414-1).

Processor 114 may be configured to execute (e.g., operate in accordance with) various signal processing programs. Each signal processing program may include one or more parameters configured to control an operation of processor 114 and/or one or more other components of hearing system 110. For example, a particular signal processing program may be configured to specify how processor 114 is to process and render audio content detected by microphones 112.

In some examples, processor 114 may operate in accordance with various signal processing programs that provide user 120 with audio signals based on different combinations (e.g., weighted combinations) of the audio content detected by microphones 112. For example, hearing system 110 may operate in accordance with a first signal processing program configured to implement beamforming by microphones 112. Such a signal processing program may include a weighted combination of signals output by microphones 112 and may be executed by processor 114 when object 130 is not in relatively close proximity to microphone 112-1. In this manner, the first signal processing program may assist user 120 with perceiving sounds generated by sources in front of user 120. In some examples, the signal processing program that implements beamforming may apply a delay and a phase inversion to one of the signals output by microphones 112 before the signals are weighted and combined.

However, when object 130 is determined to be in relatively close proximity to microphone 112-1, processor 114 may switch to operating in accordance with a second signal processing program that is based more or solely on the audio content detected by microphone 112-1 than the audio content detected by microphone 112-2. Because the second signal processing program is based more on the audio content detected by microphone 112-1 than microphone 112-2, user 120 may more easily and seamlessly hear the audio content generated by object 130. Hearing system 110 may thus dynamically and automatically switch from the first signal processing program to the second signal processing program described above and vice versa depending upon object proximity data.

As another example, processor 114 may select a signal processing program for execution by processor 114 by modifying a parameter of a signal processing program already being executed by processor 114. For example, processor 114 may adjust a beamforming parameter, a gain parameter, a noise cancelling parameter, and/or any other type of signal processing program parameter in response to detecting that object 130 is proximate to microphone 112-1.

In some examples, object 130 may be implemented by the user's hand or other type of object that does not emit sound. In this example the user may provide input to processor 114 by placing object 130 over microphone 112-1 (e.g., by cupping his or her hand over microphone 112-1). In response, processor 114 may select a particular signal processing program for execution and/or otherwise perform an operation associated with the user input.

Figure 5:
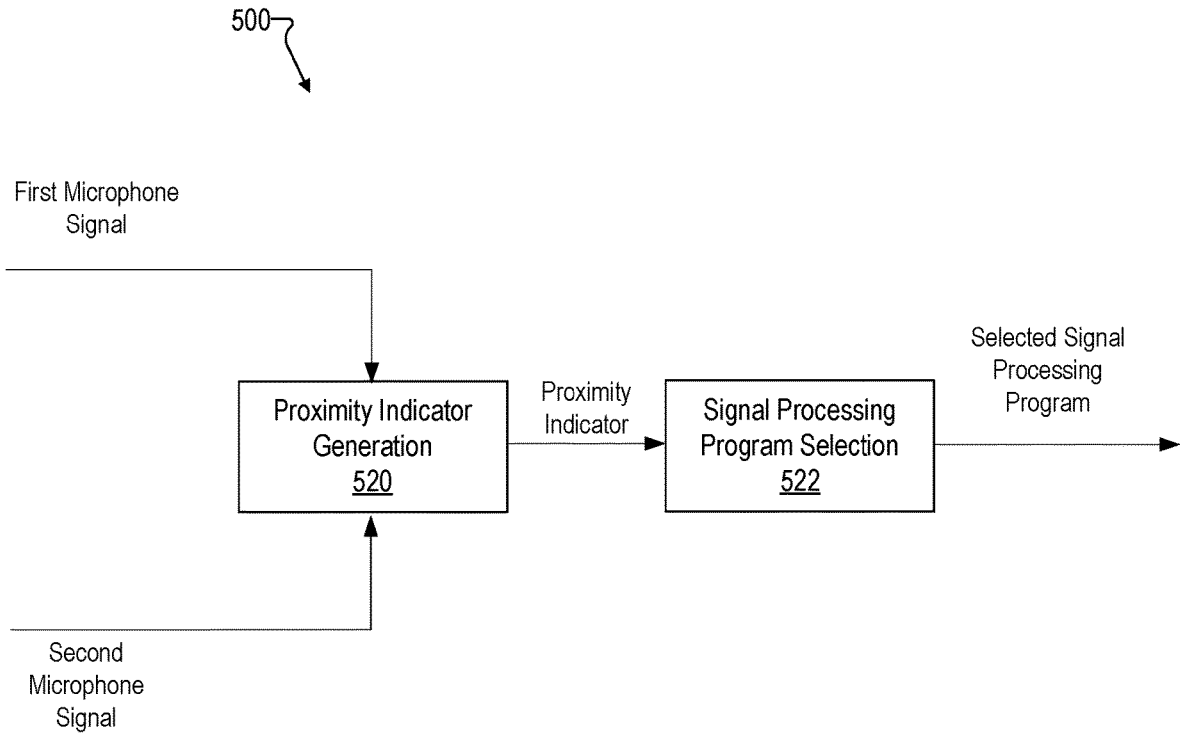
FIG. 5 illustrates various signal operations that may be performed by a hearing system according to principles described herein.

FIG. 5 illustrates various exemplary signal operations 500 that may be performed by hearing system 110 and in one example, by processor 114 of hearing system 110, according to principles described herein. As shown, a first microphone signal output by a first microphone (e.g., microphone 112-1) and a second microphone signal output by a second microphone (e.g., microphone 112-2) are received by a proximity indicator generation module 520 ("PI generation module 520"). PI generation module 520 may be implemented by processor-readable instructions configured to be executed by a processor of the hearing system (e.g., processor 114) and may be configured to determine a first acoustic spectrum of the first microphone signal and a second acoustic spectrum of the second microphone signal. This may be performed in any suitable manner. PI generation module 520 may generate, based on a comparison of the first acoustic spectrum and the second acoustic spectrum, a proximity indicator indicative of a proximity of an object to the first microphone. The proximity indicator may include a value (e.g., a number, a percentage, a range, etc.) to indicate a proximity of an object to the first microphone. Any suitable algorithms and analyses may be used to determine the proximity indicator, as described in more detail herein.

As shown, the proximity indicator is received by a signal processing program selection module 522 ("selection module 522"). Selection module 522 may be implemented by processor-readable instructions configured to be executed by a processor of the hearing system (e.g., processor 114) and configured to select, based on the received proximity indicator, a signal processing program for execution by the processor of the hearing system.

In some examples, selection module 522 may determine that the proximity indicator is above a predetermined threshold and, in response, switch from executing a first signal processing program to executing a second signal processing program. To illustrate, if the proximity indicator goes above the predetermined threshold (which may indicate that the object is in relatively close proximity to the first microphone), selection module 522 may select, for execution by the processor of the hearing system, a signal processing program that is based more on the first microphone signal than the second microphone signal. If the proximity indicator goes below the predetermined threshold (which may indicate that the object is no longer in relatively close proximity to the first microphone), selection module 522 may select, for execution by the processor of the hearing system, a signal processing program that is based on a weighted combination of the first microphone signal and the second microphone signal.

Data representative of the predetermined threshold to which selection module 522 compares the proximity indicator may be accessed or maintained by selection module 522 in any suitable manner. In some examples, a user may provide user input that sets the predetermined threshold. In other examples, the predetermined threshold may be automatically determined (e.g., by processor 114 and/or any other suitable computing device) based on one or more environmental factors, attributes of the user of hearing system 110 (e.g., whether the user is speaking), and/or other factors as may serve a particular implementation.

To illustrate, the hearing system may include a classification module (not shown) configured to receive information from the microphones to classify an environment of the user. For example, the classification module may determine whether the user is situated indoors or outdoors. The classification module may use any suitable algorithms to classify the user's environment. For example, the classification module may detect audio cues, such as wind or a lack of reverberation in the audio signal, to determine that the user is outdoors.

In another example, the hearing system may include an own voice detection module (not shown) configured to detect whether the user is speaking. In some examples, the own voice detection module may use information from the microphones and/or other sensors. For example, a bone conduction sensor may detect vibrations in the user's head caused when the user speaks. Microphones may also provide an indication that the user's own voice is being detected, based on direction, levels, signal-to-noise ratio (SNR) estimation, voice recognition techniques, etc.

The selected signal processing program from selection module 522 may optionally be sent to a wireless interface (not shown) which may provide for communication (e.g., of the selected signal processing program) with another hearing device such as in a binaural hearing system, an object such as a mobile audio source, a server via a network, and/or a cochlear implant in any suitable manner (e.g., by a Bluetooth interface, a wireless fidelity interface, and the like). The wireless interface may also be used to access signal-to-noise ratio (SNR) data and/or other such feature data of audio content detected by the hearing system.

Figure 6:
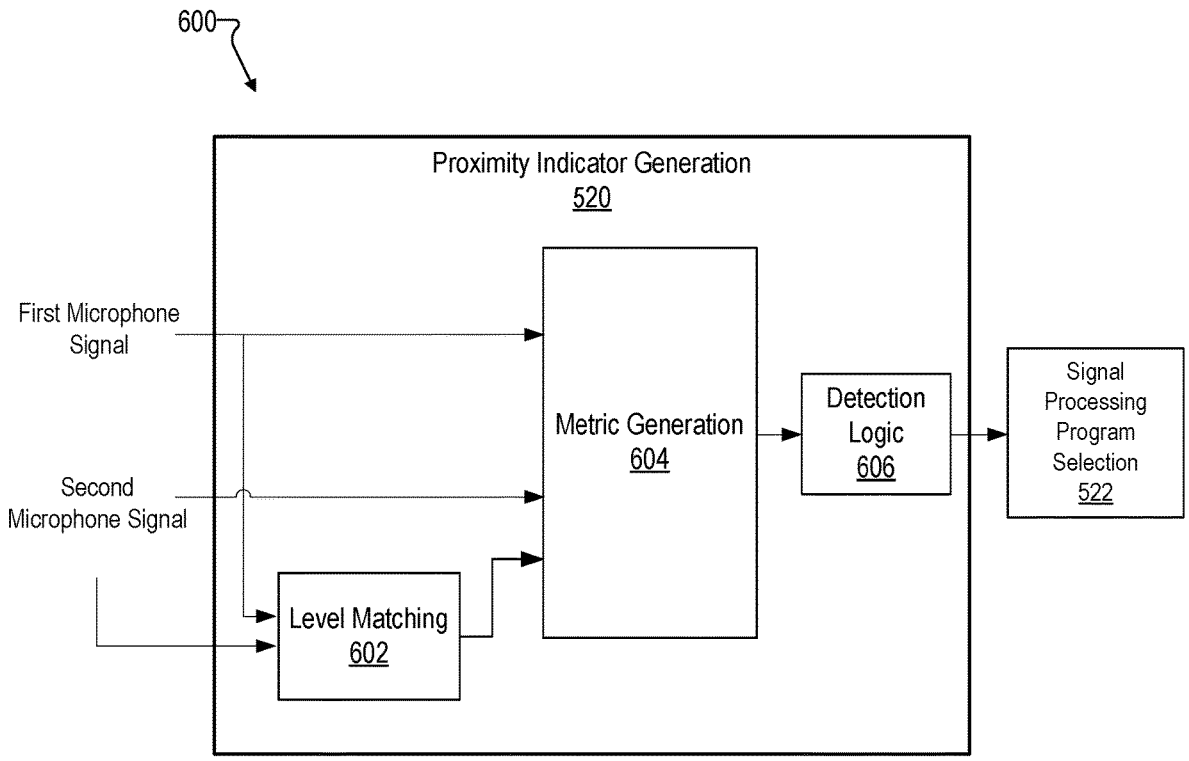
FIG. 6 illustrates other signal operations that may be performed by a hearing system according to principles described herein.

FIG. 6 illustrates exemplary signal operations 600 that may be performed by PI generation module 520 of the hearing system according to principles described herein. PI generation module 520 may be configured to include a level matching module 602, a metric generation module 604, and a detection logic module 606, which outputs the proximity indicator to selection module 522. One or more of the modules shown in FIG. 6 may be optionally not included in PI generation module 520 as may serve a particular implementation.

Level matching module 602 receives the first and second microphone signals and is configured to compensate for a difference in microphone sensitivity between the first microphone and the second microphone. Various operations may be performed to compensate for a difference in microphone sensitivity. For example, level matching module 602 may provide a level matching gain to metric generation module 604. In one example, the spectral magnitude difference between the first and second microphones may be averaged over a particular frequency range (e.g., 345 Hz-861 Hz or any other suitable frequency range). This averaged magnitude difference in microphone sensitivity may be, for example, smoothed by a lowpass filter with a time constant of any suitable duration (e.g., 5 or more seconds). The resulting smoothed value may be added to the spectral magnitude of the first microphone. In one example, the smoothing filter may be frozen if the level is too low, wind noise is present, a handset is present, or the signal is dominated by the user's own voice.

Metric generation module 604 is configured to determine one or more metrics to be used in generating the proximity indicator. In one example, metric generation module 604 may determine a metric representative of a maximum of a ratio of a magnitude of the first acoustic spectrum (i.e., the acoustic spectrum of the first microphone signal) to a magnitude of the second acoustic spectrum (i.e., the acoustic spectrum of the second microphone signal) subtracted by a mean of the ratio of the magnitude of the first acoustic spectrum to the magnitude of the second acoustic spectrum. Additionally or alternatively, metric generation module 604 may determine a metric representative of a maximum of a ratio of a magnitude of the first acoustic spectrum to a magnitude of the second acoustic spectrum subtracted by a minimum of the ratio of the magnitude of the first acoustic spectrum to the magnitude of the second acoustic spectrum. Additionally or alternatively, metric generation module may also determine a metric representative of a mean of a time delay between the first and second microphone signals.

To illustrate, metric generation module 604 may calculate two vectors from the acoustic spectra for the first and second microphone signals: (1) R(f)=ratio of first spectral magnitude to second spectral magnitude (in dB), and (2) D(f) =signal delay from second microphone to first microphone (milliseconds), where f is frequency.

Then, metric generation module 604 may determine four metrics from the above described vectors: (1) Maximum [R(f)], (2) Maximum [R(f)]-Mean [R(f)], (3) Maximum [R(f)]-Minimum [R(f)], and (4) Mean [D(f)].

In some examples, the metrics may be determined for specific frequency ranges. Such frequency ranges may include any suitable frequencies. For example, metric generation module 604 may determine the four metrics described above in accordance with the following equations: (1) Maximum [R(f1)], (2) Maximum [R(f1)]-Mean [R(f2)], (3) Maximum [R(f3)]-Minimum [R(f4)], and (4) Mean [D(f5)]. Exemplary frequency ranges represented by f1 through f5 include the following: f1 equals 861 Hz-2756 Hz, f2 equals 4307-4823 Hz, f3 equals 1378 Hz-1895 Hz, f4 equals 2239-2584 Hz, and f5 equals 345 Hz-861 Hz.

Detection logic module 606 may generate the proximity indicator based on one or more of the metrics determined by metric generation module 604. For example, detection logic module 606 may determine a maximum value of the metrics described herein to generate the proximity indicator and use the maximum value to determine the proximity indicator.

In some examples, detection logic module 606 may be configured to compare one or more metrics generated by metric generation module 604 to threshold values to determine the proximity indicator. For example, each metric may be compared to thresholds and the differences from the thresholds may be scaled and saturated to produce instantaneous object presence values ranging from −1 (object absent) to +1 (object present). In some examples, the maximum of these instantaneous object presence values may be taken across the four metrics to produce an overall instantaneous object presence value. The overall instantaneous object presence value may then be used to update a proximity indicator value ranging from 0 (which indicates that the object is absent, or, in other words, not proximate to hearing system 110) to 1 (which indicates that the object is present, or, in other words, proximate to hearing system 110). For example, the overall instantaneous object presence value may be multiplied by a scaling factor and added to the proximity indicator, with the scaling factor chosen to determine the slew rate of the proximity indicator. The proximity indicator may then be saturated to the range [0,1], and hold times may be applied when the proximity indicator reaches these endpoints. The proximity indicator may be frozen if the level is too low and/or if noise (e.g., environmental noise, such as wind) is present.

In some examples, hearing system 110 may be used in a binaural configuration to be worn by the user at both ears. For example, hearing system 110 may be implemented by a first hearing device configured to be used with a first ear and a second hearing device configured to be used with a second ear. In some examples, if the first hearing device detects that an object is in proximity to the first hearing device, the first hearing device may transmit (e.g., by way of any suitable communication link) an instruction to the second hearing device for the second hearing device to operate in accordance with a particular signal processing program.

Figure 7:
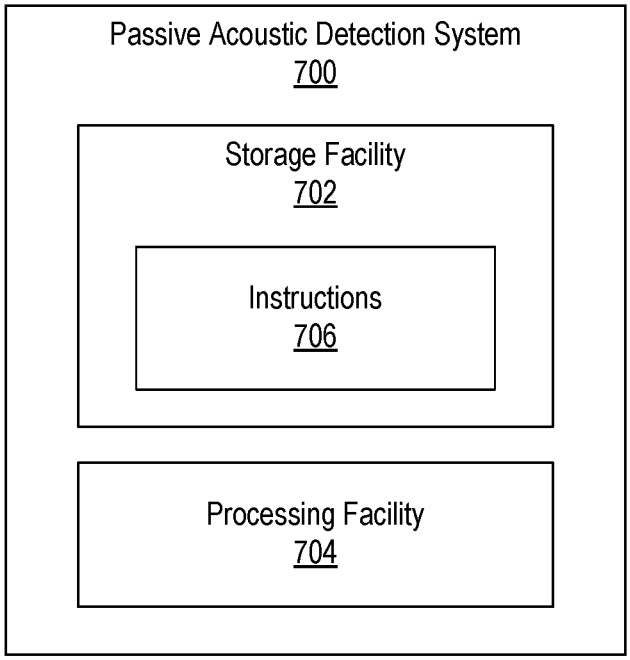
FIG. 7 illustrates an exemplary passive acoustic detection system according to principles described herein.

FIG. 7 illustrates an exemplary passive acoustic detection system 700 ("detection system 700") that may be configured to perform any of the operations described herein. As shown, detection system 700 may include, without limitation, a storage facility 702 and a processing facility 704 selectively and communicatively coupled to one another. Facilities 702 and 704 may each include or be implemented by hardware and/or software components (e.g., processors, memories, communication interfaces, instructions stored in memory for execution by the processors, etc.). In some examples, facilities 702 and 704 may be distributed between multiple devices and/or multiple locations as may serve a particular implementation.

Storage facility 702 may be implemented by any suitable type of storage medium and may maintain (e.g., store) executable data used by processing facility 704 to perform any of the operations described herein. For example, storage facility 702 may store instructions 706 that may be executed by processing facility 704 to perform any of the operations described herein. Instructions 706 may be implemented by any suitable application, software, code, and/or other executable data instance. Storage facility 702 may also maintain any data received, generated, managed, used, and/or transmitted by processing facility 704. For example, storage facility 702 may maintain data representative of a plurality of signal processing programs or audio rendering modes that specify how processing facility 704 processes (e.g., selects, combines, etc.) audio from different microphones or different types of audio content from different audio sources (e.g., ambient audio content and localized audio particular to a microphone) to present the audio content to a user.

Processing facility 704 may be configured to perform (e.g., execute instructions 706 stored in storage facility 702) any of the operations described herein. For example, processing facility 704 may be configured to perform any of the operations described herein as being performed by processor 114.

Detection system 700 may be implemented in any suitable manner. For example, detection system 700 may be implemented entirely by a processor (e.g., processor 114) included in a hearing system (e.g., hearing system 110). Additionally or alternatively, detection system 700 may be partially or entirely implemented by a computing device separate from and communicatively coupled to a hearing system.

Figure 8:
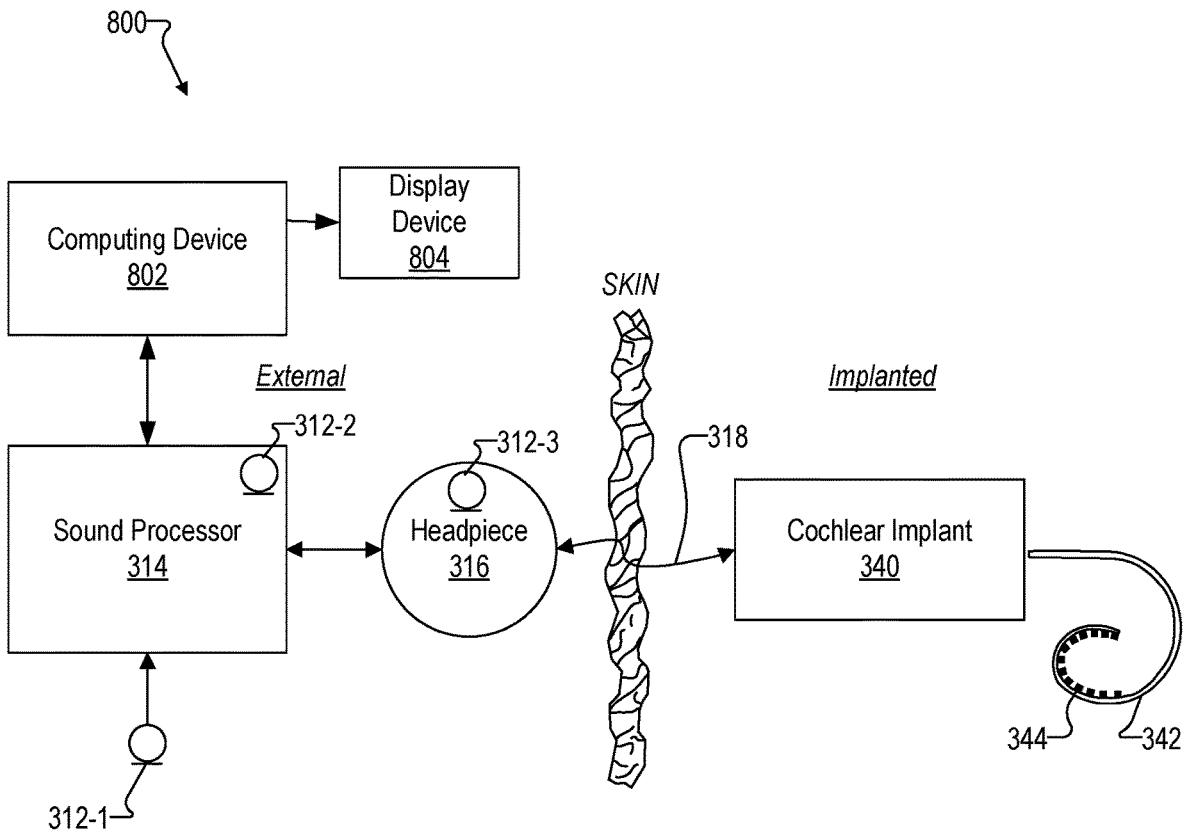
FIG. 8 illustrates an exemplary configuration including a hearing system communicatively coupled to a computing device according to principles described herein.

To illustrate, FIG. 8 shows an exemplary configuration 800 in which detection system 700 is at least partially implemented by a computing device 802 configured to communicatively couple to sound processor 314. Computing device 802 may be implemented by any suitable combination of hardware (e.g., one or more computing devices) and software. To illustrate, computing device 802 may be implemented by a mobile device (e.g., a laptop, a smartphone, a tablet computer, etc.), a fitting device, and/or any other suitable computing device as may serve a particular implementation. In some examples, computing device 802 is included in an audio source (e.g., a mobile phone) of which the proximity to a hearing system is being determined.

In some examples, computing device 802 may be communicatively coupled to a display device 804. While display device 804 is illustrated to be separate from computing device 802 in FIG. 8, display device 804 may alternatively be integrated into computing device 802. Display device 804 may be implemented by any suitable device configured to display graphical content generated by computing device 802. For example, display device 804 may display a notification message about a signal processing program which is selected.

In some examples, computing device 802 may transmit instructions to sound processor 314 for sound processor 314 to operate in accordance with a particular sound processing program. For example, in response to selecting a particular sound processing program based on a proximity of an object to microphone 312-1, computing device 802 may transmit instructions to sound processor 314 for sound processor 314 to operate in accordance with the particular sound processing program.

Figure 9:
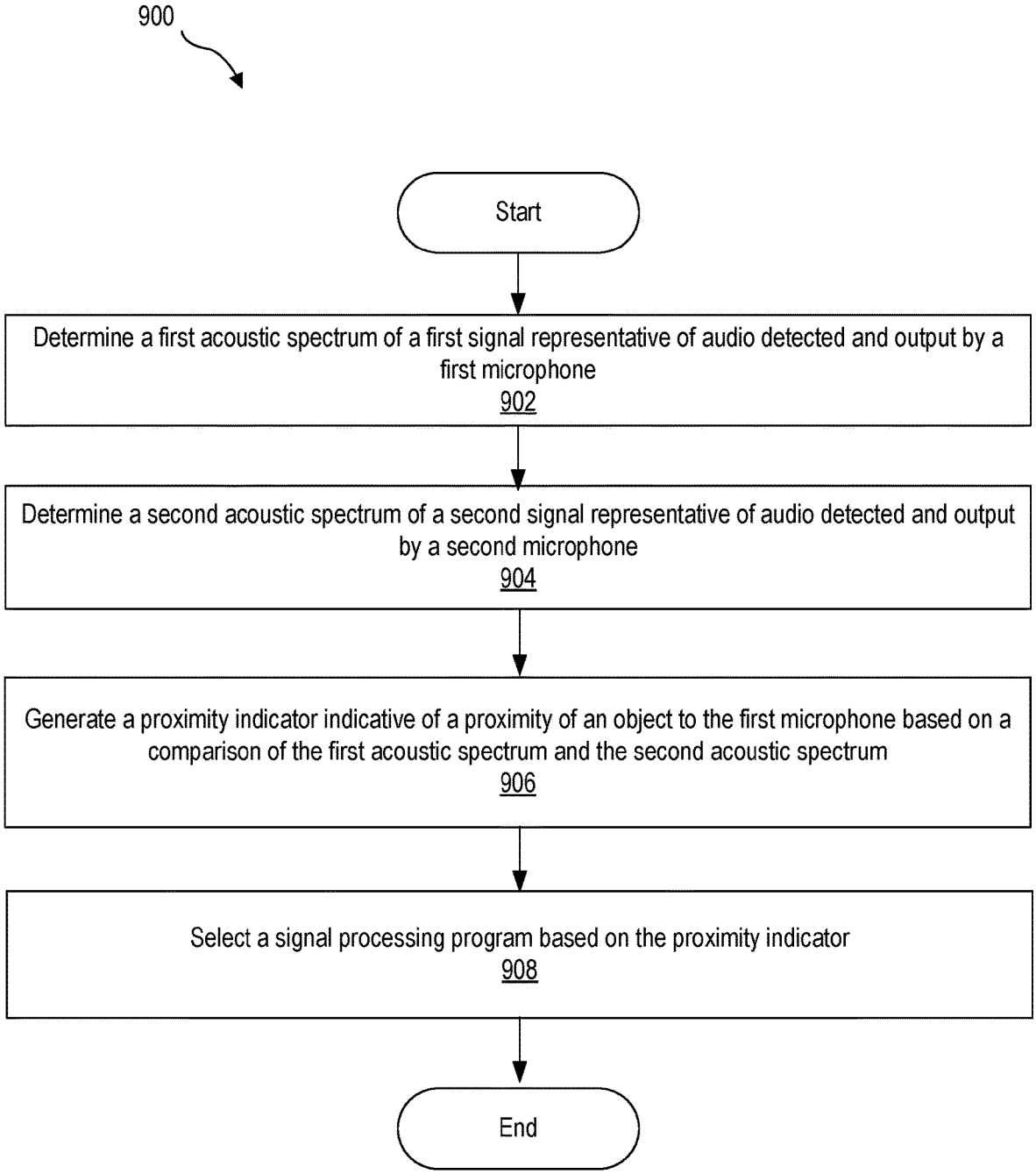
FIG. 9 illustrates an exemplary method according to principles described herein.

FIG. 9 illustrates an exemplary method 900 according to principles described herein. The operations shown in FIG. 9 may be performed by hearing system 110 and/or any implementation thereof. While FIG. 9 illustrates exemplary operations according to embodiments described herein, other embodiments may omit, add to, reorder, and/or modify any of the operations shown in FIG. 9.

In operation 902, a hearing system or passive acoustic detection system determines a first acoustic spectrum of a first signal representative of audio detected and output by a first microphone configured to be positioned at an ear canal entrance of a user. Operation 902 may be performed in any of the ways described herein.

In operation 904, the hearing system or passive acoustic detection system determines a second acoustic spectrum of a second signal representative of audio detected and output by a second microphone configured to be located away from the ear canal entrance. Operation 904 may be performed in any of the ways described herein.

In operation 906, the hearing system or passive acoustic detection system generates, based on a comparison of the first acoustic spectrum and the second acoustic spectrum, a proximity indicator indicative of a proximity of an object to the first microphone. Operation 906 may be performed in any of the ways described herein.

In operation 908, the hearing system or passive acoustic detection system selects, based on the proximity indicator, a signal processing program for execution by the passive acoustic detection system. Operation 908 may be performed in any of the ways described herein.

In some examples, a non-transitory computer-readable medium storing computer-readable instructions may be provided in accordance with the principles described herein. The instructions, when executed by a processor of a computing device, may direct the processor and/or computing device to perform one or more operations, including one or more of the operations described herein. Such instructions may be stored and/or transmitted using any of a variety of known computer-readable media.

A non-transitory computer-readable medium as referred to herein may include any non-transitory storage medium that participates in providing data (e.g., instructions) that may be read and/or executed by a computing device (e.g., by a processor of a computing device). For example, a non-transitory computer-readable medium may include, but is not limited to, any combination of non-volatile storage media and/or volatile storage media. Exemplary non-volatile storage media include, but are not limited to, read-only memory, flash memory, a solid-state drive, a magnetic storage device (e.g. a hard disk, a floppy disk, magnetic tape, etc.), ferroelectric random-access memory ("RAM"), and an optical disc (e.g., a compact disc, a digital video disc, a Blu-ray disc, etc.). Exemplary volatile storage media include, but are not limited to, RAM (e.g., dynamic RAM).

Figure 10:
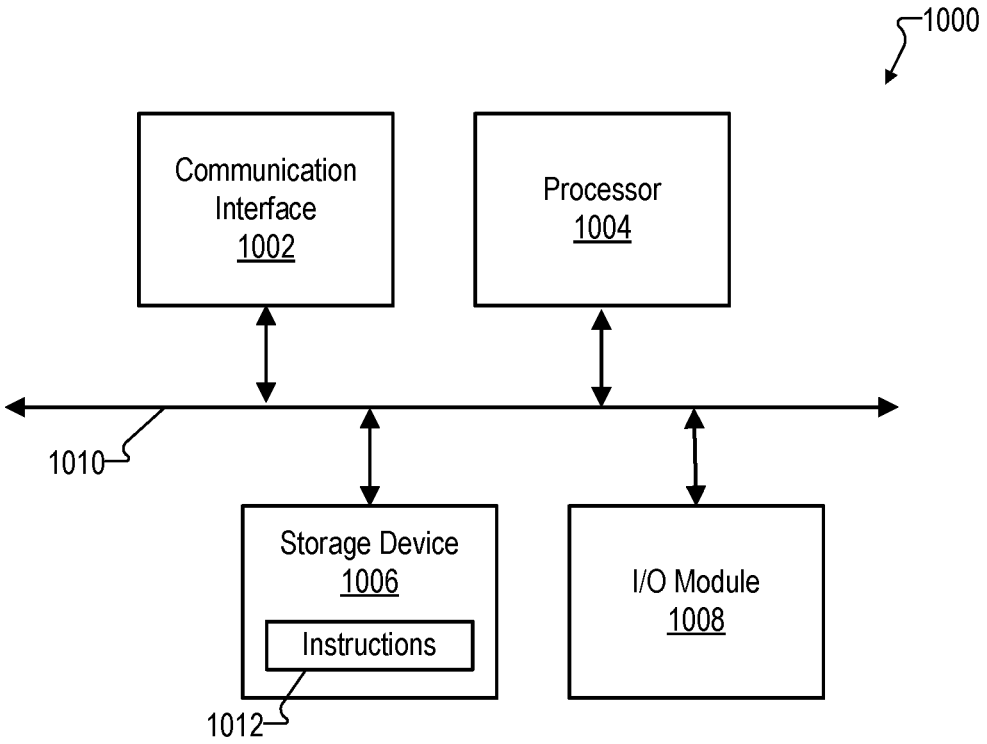
FIG. 10 illustrates an exemplary computing device according to principles described herein.

FIG. 10 illustrates an exemplary computing device 1000 that may be specifically configured to perform one or more of the processes described herein. As shown in FIG. 10, computing device 1000 may include a communication interface 1002, a processor 1004, a storage device 1006, and an input/output ("I/O") module 1008 communicatively connected one to another via a communication infrastructure 1010. While an exemplary computing device 1000 is shown in FIG. 10, the components illustrated in FIG. 10 are not intended to be limiting. Additional or alternative components may be used in other embodiments. Components of computing device 1000 shown in FIG. 10 will now be described in additional detail.

Communication interface 1002 may be configured to communicate with one or more computing devices. Examples of communication interface 1002 include, without limitation, a wired network interface (such as a network interface card), a wireless network interface (such as a wireless network interface card), a modem, an audio/video connection, and any other suitable interface.

Processor 1004 generally represents any type or form of processing unit capable of processing data and/or interpreting, executing, and/or directing execution of one or more of the instructions, processes, and/or operations described herein. Processor 1004 may perform operations by executing computer-executable instructions 1012 (e.g., an application, software, code, and/or other executable data instance) stored in storage device 1006.

Storage device 1006 may include one or more data storage media, devices, or configurations and may employ any type, form, and combination of data storage media and/or device. For example, storage device 1006 may include, but is not limited to, any combination of the non-volatile media and/or volatile media described herein. Electronic data, including data described herein, may be temporarily and/or permanently stored in storage device 1006. For example, data representative of computer-executable instructions 1012 configured to direct processor 1004 to perform any of the operations described herein may be stored within storage device 1006. In some examples, data may be arranged in one or more databases residing within storage device 1006.

I/O module 1008 may include one or more I/O modules configured to receive user input and provide user output. I/O module 1008 may include any hardware, firmware, software, or combination thereof supportive of input and output capabilities. For example, I/O module 1008 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1008 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1008 is configured to provide graphical data to a display for presentation to a user. The graphical data may be representative of one or more graphical user interfaces and/or any other graphical content as may serve a particular implementation.

In some examples, any of the systems, computing devices, and/or other components described herein may be implemented by computing device 1000. For example, storage facility 702 may be implemented by storage device 1006, and processing facility 704 may be implemented by processor 1004.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A hearing system associated with a first ear of a user, the hearing system comprising:

a first microphone configured to be positioned at an ear canal entrance of the first ear of the user and output a first signal representative of audio detected by the first microphone;

a second microphone disposed on a component of the hearing system configured to be located away from the ear canal entrance, the second microphone configured to output a second signal representative of audio detected by the second microphone; and a processor communicatively coupled to the first and second microphones and configured to:

determine a first acoustic spectrum of the first signal output by the first microphone;

determine a second acoustic spectrum of the second signal output by the second microphone;

generate, based on a comparison of the first acoustic spectrum and the second acoustic spectrum, a proximity indicator indicative of a proximity of an object to the first microphone, the object including one or more of a mobile device, a telephone handset, a headphone, an earphone, or a hand; and select, based on the proximity indicator, a signal processing program for execution by the processor.

2. The hearing system of claim 1, further comprising a housing configured to house the processor, wherein:

the first microphone is configured to removably attach to the housing; and the second microphone is disposed on the housing.

3. The hearing system of claim 1, further comprising:

a housing configured to house the processor; and a headpiece separate from the housing and configured to house a coil used by the processor to wirelessly communicate with a cochlear implant;

wherein the second microphone is disposed on the headpiece.

4. The hearing system of claim 1, wherein the processor is implemented by a sound processor in a cochlear implant system.

5. The hearing system of claim 1, wherein the processor is implemented by a processor in a hearing device configured to acoustically present the audio to the user.

6. The hearing system of claim 1, wherein the generating of the proximity indicator comprises:

determining a metric representative of a maximum of a ratio of a magnitude of the first acoustic spectrum to a magnitude of the second acoustic spectrum; and determining, based on the metric, the proximity indicator.

7. The hearing system of claim 1, wherein the generating of the proximity indicator comprises:

determining a metric representative of a maximum of a ratio of a magnitude of the first acoustic spectrum to a magnitude of the second acoustic spectrum subtracted by a mean of the ratio of the magnitude of the first acoustic spectrum to the magnitude of the second acoustic spectrum; and determining, based on the metric, the proximity indicator.

8. The hearing system of claim 1, wherein the generating of the proximity indicator comprises:

determining a metric representative of a maximum of a ratio of a magnitude of the first acoustic spectrum to a magnitude of the second acoustic spectrum subtracted by a minimum of the ratio of the magnitude of the first acoustic spectrum to the magnitude of the second acoustic spectrum; and determining, based on the metric, the proximity indicator.

9. The hearing system of claim 1, wherein the generating of the proximity indicator comprises:

determining a metric representative of a mean of a time delay between the first and second signals; and determining, based on the metric, the proximity indicator.

10. The hearing system of claim 1, wherein the generating of the proximity indicator comprises:

determining a first metric representative of a maximum of a ratio of a magnitude of the first acoustic spectrum to a magnitude of the second acoustic spectrum;

determining a second metric representative of a maximum of a ratio of a magnitude of the first acoustic spectrum to a magnitude of the second acoustic spectrum subtracted by a mean of the ratio of the magnitude of the first acoustic spectrum to the magnitude of the second acoustic spectrum;

determining a third metric representative of a maximum of a ratio of a magnitude of the first acoustic spectrum to a magnitude of the second acoustic spectrum subtracted by a minimum of the ratio of the magnitude of the first acoustic spectrum to the magnitude of the second acoustic spectrum;

determining a fourth metric representative of a mean of a time delay between the first and second signals;

determining a maximum value of the first through fourth metrics; and determining, based on the maximum value of the first through fourth metrics, the proximity indicator.

11. The hearing system of claim 1, wherein the object emits the audio.

12. The hearing system of claim 1, wherein the object does not emit the audio.

13. The hearing system of claim 1, wherein the processor is further configured to compensate for a difference in microphone sensitivity between the first microphone and the second microphone.

14. The hearing system of claim 1, wherein the selecting of the signal processing program for execution by the processor comprises:

determining that the proximity indicator is above a predetermined threshold; and switching, in response to the determining that the proximity indicator is above the predetermined threshold, from executing a first signal processing program to executing a second signal processing program.

15. The hearing system of claim 1, wherein the processor is configured to select, if the proximity indicator is above a predetermined threshold, a signal processing program that increases input from the first microphone more than the second microphone.

16. The hearing system of claim 1, wherein the processor is configured to select, if the proximity indicator is below a predetermined threshold, a signal processing program that includes beamforming.

17. The hearing system of claim 1, wherein the selecting of the signal processing program for execution by the processor comprises modifying a parameter of a signal processing program already being executed by the processor.

18. A passive acoustic detection system comprising:

a memory storing instructions;

a processor communicatively coupled to the memory and configured to execute the instructions to:

determine a first acoustic spectrum of a first signal representative of audio detected and output by a first microphone configured to be positioned at an ear canal entrance of a first ear of a user;

determine a second acoustic spectrum of a second signal representative of audio detected and output by a second microphone configured to be located away from the ear canal entrance;

generate, based on a comparison of the first acoustic spectrum and the second acoustic spectrum, a proximity indicator indicative of a proximity of an object to the first microphone, the object including one or more of a mobile device, a telephone handset, a headphone, an earphone, or a hand; and select, based on the proximity indicator, a signal processing program for execution by a hearing system associated with the user.

19. A method comprising:

determining, by a passive acoustic detection system, a first acoustic spectrum of a first signal representative of audio detected and output by a first microphone configured to be positioned at an ear canal entrance of a user;

determining, by the passive acoustic detection system, a second acoustic spectrum of a second signal representative of audio detected and output by a second microphone configured to be located away from the ear canal entrance;

generating, by the passive acoustic detection system, a proximity indicator indicative of a proximity of an object to the first microphone based on a comparison of the first acoustic spectrum and the second acoustic spectrum, the object including one or more of a mobile device, a telephone handset, a headphone, an earphone, or a hand; and selecting, by the passive acoustic detection system based on the proximity indicator, a signal processing program for execution by the passive acoustic detection system.

20. A hearing system associated with a first ear of a user, the hearing system comprising:

a first microphone configured to be positioned at an ear canal entrance of the first ear of the user and output a first signal representative of audio detected by the first microphone;

a second microphone disposed on a component of the hearing system configured to be located away from the ear canal entrance, the second microphone configured to output a second signal representative of audio detected by the second microphone; and a processor communicatively coupled to the first and second microphones and configured to:

determine a first acoustic spectrum of the first signal output by the first microphone;

determine a second acoustic spectrum of the second signal output by the second microphone;

generate, based on a comparison of the first acoustic spectrum and the second acoustic spectrum, a proximity indicator indicative of a proximity of an object to the first microphone; and select, based on the proximity indicator, a signal processing program for execution by the processor; wherein A. the hearing system further comprises a housing configured to house the processor;

the first microphone is configured to removably attach to the housing; and the second microphone is disposed on the housing; or B. the hearing system further comprises:

a housing configured to house the processor; and a headpiece separate from the housing and configured to house a coil used by the processor to wirelessly communicate with a cochlear implant;

wherein the second microphone is disposed on the headpiece; or

C. the processor is implemented by a sound processor in a cochlear implant system; or D. the processor is implemented by a processor in a hearing device configured to acoustically present the audio to the user; or E. the generating of the proximity indicator comprises:
determining a metric representative of a maximum of a ratio of a magnitude of the first acoustic spectrum to a magnitude of the second acoustic spectrum; and
determining, based on the metric, the proximity indicator; or F. the generating of the proximity indicator comprises:
determining a metric representative of a maximum of a ratio of a magnitude of the first acoustic spectrum to a magnitude of the second acoustic spectrum subtracted by a mean of the ratio of the magnitude of the first acoustic spectrum to the magnitude of the second acoustic spectrum; and
determining, based on the metric, the proximity indicator; or G. the generating of the proximity indicator comprises:
determining a metric representative of a maximum of a ratio of a magnitude of the first acoustic spectrum to a magnitude of the second acoustic spectrum subtracted by a minimum of the ratio of the magnitude of the first acoustic spectrum to the magnitude of the second acoustic spectrum; and
determining, based on the metric, the proximity indicator; or H. the generating of the proximity indicator comprises:
determining a metric representative of a mean of a time delay between the first and second signals; and
determining, based on the metric, the proximity indicator; or I. the generating of the proximity indicator comprises:
determining a first metric representative of a maximum of a ratio of a magnitude of the first acoustic spectrum to a magnitude of the second acoustic spectrum;
determining a second metric representative of a maximum of a ratio of a magnitude of the first acoustic spectrum to a magnitude of the second acoustic spectrum subtracted by a mean of the ratio of the magnitude of the first acoustic spectrum to the magnitude of the second acoustic spectrum;
determining a third metric representative of a maximum of a ratio of a magnitude of the first acoustic spectrum to a magnitude of the second acoustic spectrum subtracted by a minimum of the ratio of the magnitude of the first acoustic spectrum to the magnitude of the second acoustic spectrum;
determining a fourth metric representative of a mean of a time delay between the first and second signals;
determining a maximum value of the first through fourth metrics; and
determining, based on the maximum value of the first through fourth metrics, the proximity indicator; or J. the object includes one or more of a mobile device, a telephone handset, a headphone, an earphone, or a hand; or K. the object does not emit the audio; or L. the processor is further configured to compensate for a difference in microphone sensitivity between the first microphone and the second microphone; or M. the processor is configured to select, if the proximity indicator is above a predetermined threshold, a signal processing program that increases input from the first microphone more than the second microphone; or N. the processor is configured to select, if the proximity indicator is below a predetermined threshold, a signal processing program that includes beamforming.

* * * * *